US008330665B2

(12) United States Patent
Kaikkonen et al.

(10) Patent No.: US 8,330,665 B2
(45) Date of Patent: Dec. 11, 2012

(54) ANTENNA DEVICE AND PORTABLE RADIO COMMUNICATION DEVICE COMPRISING SUCH ANTENNA DEVICE

(76) Inventors: Andrei Kaikkonen, Järfälla (SE); Peter Lindberg, Uppsala (SE); Axel von Arbin, Täby (SE)

( * ) Notice: Subject to any disclaimer, the term of this patent is extended or adjusted under 35 U.S.C. 154(b) by 322 days.

(21) Appl. No.: 12/745,230

(22) PCT Filed: Nov. 25, 2008

(86) PCT No.: PCT/SE2008/051342

§ 371 (c)(1),
(2), (4) Date: Jun. 9, 2010

(87) PCT Pub. No.: WO2009/070100

PCT Pub. Date: Jun. 4, 2009

(65) Prior Publication Data

US 2010/0302114 A1 Dec. 2, 2010

(30) Foreign Application Priority Data

Nov. 30, 2007 (EP) ..... 07445044

(51) Int. Cl.
*H01Q 1/00* (2006.01)

(52) U.S. Cl. ..... 343/722; 343/752; 343/741

(58) Field of Classification Search ..... 343/722, 343/752, 741, 702

See application file for complete search history.

(56) References Cited

U.S. PATENT DOCUMENTS 5,767,813 A 6/1998 Verma et al.
2002/0118075 A1* 8/2002 Ohwada et al. ..... 333/32
2008/0224943 A1* 9/2008 Konaka ..... 343/876
2009/0251383 A1 10/2009 Tani et al.

FOREIGN PATENT DOCUMENTS

EP 1120855 8/2001
EP 1545013 6/2005
EP 1594188 11/2005
EP 1594188 A1 * 11/2005

(Continued)

OTHER PUBLICATIONS

International Preliminary Report on Patentability for International Application No. PCT/SE2008/051342 dated Jun. 10, 2010 (6 pages).

(Continued)

*Primary Examiner* — Douglas W Owens
*Assistant Examiner* — Collin Dawkins
(74) *Attorney, Agent, or Firm* — Harness, Dickey & Pierce, P.L.C.

(57) ABSTRACT

The present invention relates to an antenna device for a portable radio communication device adapted for receiving and/or transmitting radio signals in at least a first and a second operating frequency band, said antenna device comprising a half-loop radiating element, comprising a feeding portion and a grounding portion, and arranged to operate at FM frequencies. The antenna device comprises a capacitor at said feeding portion and an inductor at said grounding portion, and said half-loop radiating element is arranged to simultaneously with FM frequencies operate at frequencies at least ten times higher than FM frequencies, wherein said capacitor is arranged to short circuit said half-loop radiating element to ground for frequencies at least ten times higher than FM frequencies and said inductor is arranged to short circuit said half-loop radiating element to ground for FM frequencies.

17 Claims, 2 Drawing Sheets

FOREIGN PATENT DOCUMENTS

| | | | |
|---|---|---|---|
| EP | 1850475 | | 10/2007 |
| EP | 1850475 | A1 * | 10/2007 |
| JP | 61-265905 | | 11/1986 |
| WO | WO2006064590 | | 6/2006 |
| WO | WO 2006088422 | A1 * | 8/2006 |
| WO | WO2007123454 | | 11/2007 |

OTHER PUBLICATIONS

European office action from EP Application No. 07445044.6, dated Feb. 14, 2011, 5 pages. The current application is a U.S. national phase of PCT application No. PCT/SE2008/051342 (now published as WO 2009/070100) which claims direct priority to EP07445044.6 (now published as EP 2065969).

Lindberg, Peter et al., "Built-in handset antennas enable FM transceivers in mobile phones" retrieved from the Internet at http://rfdesign.com/mag/707RFDF1.pdf, dated Jul. 20, 2007 (4 pages).

European Search Report dated Apr. 28, 2008 for European Application No. 07445044.6 (7 pages).

International Search Report dated Feb. 27, 2009 for International Application No. PCT/SE2008/051342 (3 pages).

Written Opinion of International Searching Authority dated Feb. 27, 2009 for International Application No. PCT/SE2008/051342 (4 pages).

* cited by examiner

ANTENNA DEVICE AND PORTABLE RADIO COMMUNICATION DEVICE COMPRISING SUCH ANTENNA DEVICE

CROSS REFERENCE TO RELATED APPLICATIONS

This application is a 371 of PCT International Application No. PCT/SE2008/0513428 filed Nov. 25, 2008, published as WO2009/070100, which claims priority to pending European Application No. 07445044.6 filed Nov. 30, 2007 (now published as EP2065969). The disclosures of the above applications are incorporated herein by reference in their entirety.

FIELD OF INVENTION

The present invention relates generally to antenna devices and more particularly to an antenna device for use in a portable radio communication device, such as a mobile phone, which antenna device is adapted for receiving radio signals having a relatively low frequency, such as radio signals in the FM frequency band.

BACKGROUND

Internal antennas have been used for some time in portable radio communication devices. There are a number of advantages connected with using internal antennas, of which can be mentioned that they are small and light, making them suitable for applications wherein size and weight are of importance, such as in mobile phones, PDA, portable computer or similar devices.

However, the application of internal antennas in a mobile phone puts some constraints on the configuration of the antenna element. In particular, in a portable radio communication device the space for an internal antenna device is limited. These constraints may make it difficult to find a configuration of the antenna device that provides for desired use. This is especially true for antennas intended for use with radio signals of relatively low frequencies as the desired physical length of such antennas are large compared to antennas operating with relatively high frequencies.

One specific application operating in a relatively low frequency band is the FM radio application. The FM operating band is defined as frequencies between 88-108 MHz in most of the world and frequencies between 76-90 MHz in Japan. Prior art conventional antenna configurations, such as loop antennas or monopole antennas, fitted within the casing of a portable radio communication device will result in unsatisfactory operation in that the antenna either has too bad performance over a sufficiently wide frequency band or sufficient performance over a too narrow frequency band.

Instead, a conventional FM antenna for portable radio communication devices is usually provided in the headset wire connected to the communication device. This configuration with a relatively long wire permits an antenna length that is sufficient also for low frequency applications. However, if no external antenna is permitted this solution is obviously not feasible.

Further, a portable radio communication device is today many times provided with frequency operational coverage for other frequency bands then FM, such as GSM900, GSM1800, GPS, Bluetooth, WLAN and WCDMA. A portable radio communication device has limited space and it is thus desirable to, if possible, add multiple functionality to an antenna device.

SUMMARY OF THE INVENTION

An object of the present invention is to provide an antenna device for use in a portable radio communication device, which efficiently utilizes available space of the portable radio communication device and provides for at least FM frequency band operation.

According to the present invention there is provided an antenna device for a portable radio communication device adapted for receiving and/or transmitting radio signals in at least a first and a second operating frequency band, the antenna device comprising a half-loop radiating element. The half-loop radiating element comprising a feeding portion and a grounding portion, and being arranged to operate at FM frequencies. The antenna device comprises a capacitor at the feeding portion and an inductor at the grounding portion, and the half-loop radiating element is arranged to simultaneously with FM frequencies operate at frequencies at least ten times higher than FM frequencies, wherein the capacitor is arranged to short circuit the half-loop radiating element to ground for frequencies at least ten times higher than FM frequencies and the inductor is arranged to short circuit the half-loop radiating element to ground for FM frequencies.

By utilization of two very distinct operating frequency bands both bands can operate simultaneously on the radiating element, without use of any switches or similar functionality.

The frequency band at least ten times higher than FM frequencies advantageously comprises one or more of the following frequency bands: GPS, Bluetooth, WLAN and WCDMA diversity. Particularly Bluetooth is today often desired in a portable radio communication device.

Preferably, the antenna device is further adapted for transmitting radio signals for FM frequencies, to provide e.g. the possibility to send information from the portable radio communication device to a FM receiver in a car.

Usually the half-loop antenna radiator is tuned to the frequency band at least ten times higher than FM frequencies by means of the inductor, but depending of the properties of the FM receiver and matching thereof, a capacitor may instead be needed for tuning. The inductor is however still needed for FM frequency grounding. The antenna device thus preferably comprises a second capacitor arranged parallel to the inductor.

A portable radio communication device comprising an antenna device as described above is also provided.

Further preferred embodiments are defined in the dependent claims.

BRIEF DESCRIPTION OF DRAWINGS

The present invention will become more fully understood from the detailed description of embodiments given below and the accompanying figures, which are given by way of illustration only, and thus, are not limitative of the present invention, wherein.

DETAILED DESCRIPTION OF THE INVENTION

In the following description, for purpose of explanation and not limitation, specific details are set forth, such as particular techniques and applications in order to provide a thorough understanding of the present invention. However, it will be apparent for a person skilled in the art that the present invention may be practiced in other embodiments that depart from these specific details. In other instances, detailed description of well-known methods and apparatuses are omitted so as not to obscure the description of the present invention with unnecessary details.

In the following description and claims, the term radiating element is used. It is to be understood that this term is intended to cover electrically conductive elements arranged for receiving and/or transmitting radio signals.

Figure 1:
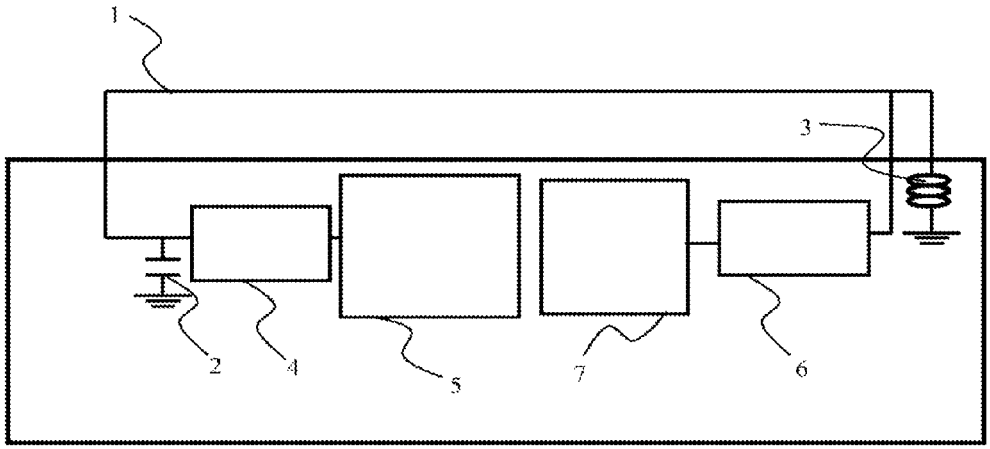
FIG. 1 is a schematic diagram showing a first embodiment of an antenna device according to the present invention.
Figure 2:
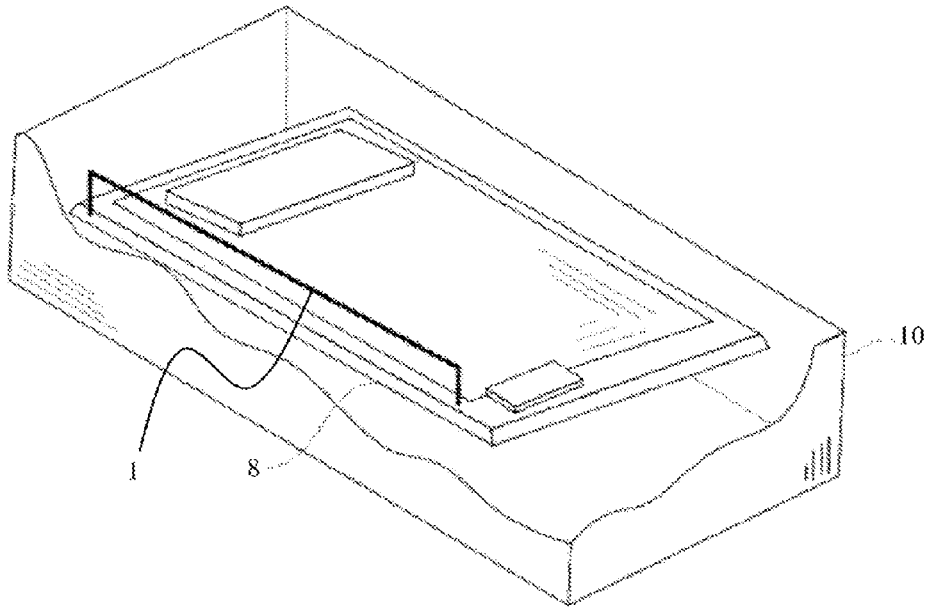
FIG. 2 is a perspective partially cut-away view of an antenna device according to the present invention mounted in a portable radio communication device.

With reference to FIGS. 1 and 2 a first embodiment of an antenna device according to the present invention is described. The antenna device comprises a half-loop radiating element 1, having a feeding portion and a grounding portion regarding FM frequencies. A half-loop antenna is a virtual loop antenna, by being provided over a ground plane device. The antenna device further comprises a capacitor 2 at the feeding portion for tuning the half-loop radiating element 1 to FM frequencies and an inductor 3 at the grounding portion.

The antenna device is further arranged to simultaneously with FM frequencies operate at frequencies at least ten times higher than FM frequencies, such as for GPS, Bluetooth, WLAN and WCDMA diversity. Preferably, the antenna device is arranged to simultaneously operate with FM frequencies and Bluetooth frequencies, which both provide much desired functions.

The capacitor 2 is arranged to short circuit the half-loop radiating element 1 to ground for frequencies at least ten times higher than FM frequencies. A capacitance of about 10-50 pF is appropriate to provide a short circuit for frequencies at least ten times higher than FM frequencies and to simultaneously tune the half-loop radiating element 1 for FM frequencies.

The inductor 3 is arranged to short circuit the half-loop radiating element 1 to ground for FM frequencies. An inductance of about less than 10 nH is appropriate to provide a short circuit for FM frequencies, at the same time preventing short circuit for frequencies at least ten times higher than FM frequencies. The inductor 3 is further preferably used for tuning of the half-loop radiating element 1 for frequencies at least ten times higher than FM frequencies.

A portable radio communication device 10 comprising an antenna device as described above comprises a ground plane device below the half-loop radiating element 1 to provide a virtual loop antenna. The ground plane device is e.g. provided as a printed wiring board 8 of the portable radio communication device 10. The portable radio communication device 10 is further provided with a first matching network or filter 4 for a FM receiver 5, and a second matching network or filter 6 for e.g. a Bluetooth transceiver 7. The first matching network or filter 4 for the FM receiver 5 is connected to the feeding portion of the half-loop radiating element 1. The second matching network or filter 6 for the Bluetooth transceiver 7 is connected to the grounding portion of the half-loop radiating element 1.

Figure 3:
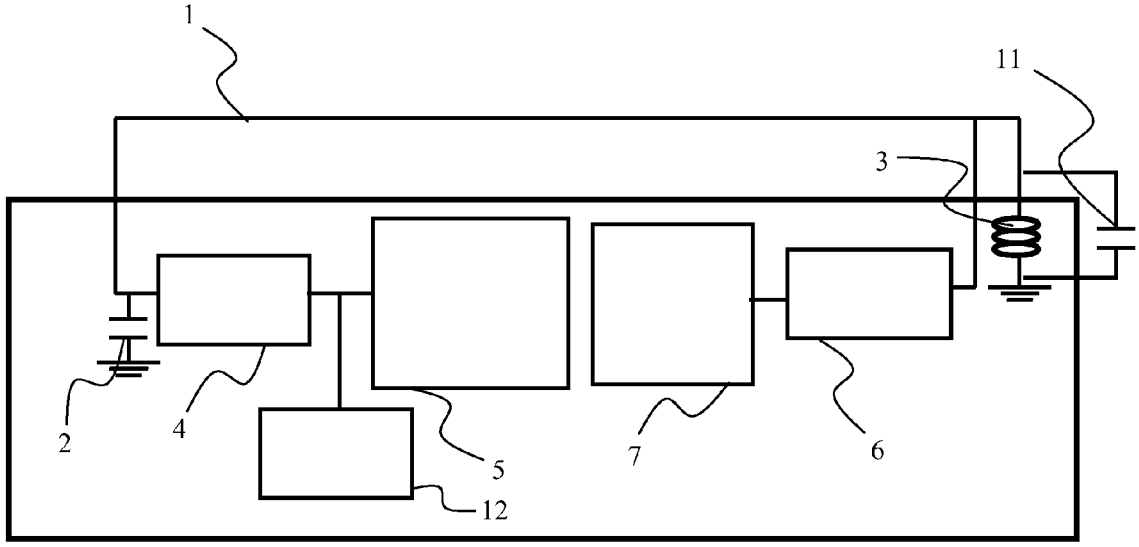
FIG. 3 is a schematic diagram showing a second embodiment of an antenna device of the present invention.

A second embodiment of an antenna device according to the present invention is schematically shown in FIG. 3. The second embodiment of the antenna device is identical with the first embodiment of the antenna device described above apart from the following.

The antenna device is further adapted for transmitting radio signals for FM frequencies. The portable radio communication device comprises a FM transmitter 12 connected to the feeding portion of the half-loop radiating element 1. The first matching network or filter 4 for is preferably common for the FM receiver and the FM transmitter.

Further, a second capacitor 11 is preferably arranged parallel to the inductor 3, when the properties of the half-loop radiating element 1, the FM receiver 5, the first matching network or filter 4, requires capacitance tuning for the Bluetooth function. The use of a second capacitor arranged parallel to the inductor 3 can also be utilized in the first embodiment described above for the same purpose.

It will be obvious that the present invention may be varied in a plurality of ways. Such variations are not to be regarded as departure from the scope of the present invention as defined by the appended claims. All such variations as would be obvious for a person skilled in the art are intended to be included within the scope of the present invention as defined by the appended claims.

The invention claimed is:

1. An antenna device for a portable radio communication device adapted for receiving and/or transmitting radio signals in at least a first and a second operating frequency band, the antenna device comprising:

a half-loop radiating element including a feeding portion at a first end of the half-loop radiating element, and a grounding portion at a second end of the half-loop radiating element, the half-loop radiating element arranged to operate at FM frequencies;

a capacitor at the feeding portion;

an inductor at the grounding portion;

a first matching network or filter connected to the first end of the half-loop radiating element at the feeding portion, for a FM receiver; and a second matching network or filter connected to the second end of the half-loop radiating element at the grounding portion, for another receiver for frequencies at least ten times higher than FM frequencies;

the first matching network or filter is connected to the capacitor in parallel;

the second matching network or filter is connected to the inductor in parallel;

the half-loop radiating element is arranged to simultaneously with FM frequencies operate at frequencies at least ten times higher than FM frequencies;

the capacitor is arranged to short circuit the half-loop radiating element to ground for frequencies at least ten times higher than FM frequencies; and the inductor is arranged to short circuit the half-loop radiating element to ground for FM frequencies.

2. The antenna device according to claim 1, wherein the frequencies at least ten times higher than FM frequencies comprises one or more of the following frequency bands: GPS, Bluetooth, WLAN, and WCDMA diversity.

3. The antenna device according to claim 1, wherein the antenna device is further adapted for receiving and transmitting radio signals for FM frequencies.

4. The antenna device according to claim 1, comprising a second capacitor arranged parallel to the inductor.

5. A portable radio communication device comprising the antenna device according to claim 1 arranged over a ground plane device.

6. The portable radio communication device according to claim 5, comprising:

a FM receiver connected to the antenna device at the feeding portion; and another receiver for frequencies at least ten times higher than FM frequencies connected to the antenna device at the grounding portion.

7. The portable radio communication device according to claim 5, comprising a FM transmitter connected to the antenna device at the feeding portion.

8. The portable radio communication device according to claim 5, comprising a Bluetooth transceiver for frequencies at least ten times higher than FM frequencies connected to the antenna device at the grounding portion.

9. The antenna device according to claim 1, wherein the frequencies at least ten times higher than FM frequencies comprises Bluetooth.

10. The antenna device according to claim 1, wherein:

the capacitor has a capacitance of about 10-50 pF; and/or the inductor has an inductance of about less than 10 nH.

11. The antenna device according to claim 1, wherein the inductor is configured to provide a short circuit for FM frequencies, at the same time preventing short circuit for frequencies at least ten times higher than FM frequencies.

12. The antenna device according to claim 1, wherein the inductor is operable for tuning the half-loop radiating element for frequencies at least ten times higher than FM frequencies.

13. The antenna device according to claim 1, wherein the antenna device is operable simultaneously in the first and second operating frequency bands on the half-loop radiating element without requiring the use of any switches.

14. An antenna device for a portable radio communication device, the antenna device comprising:

a half-loop radiating element including a feeding portion at a first end of the half-loop radiating element and a grounding portion at a second end of the half-loop radiating element, the half-loop radiating element configured to simultaneously with FM frequencies operate at frequencies at least ten times higher than FM frequencies, the half-loop radiating element configured such that feeding of the FM frequencies is performed through the feeding portion and the feeding of the frequencies at least ten times higher than FM frequencies is performed through the grounding portion;

a capacitor connected to the feeding portion, and configured to short circuit the half-loop radiating element to ground for frequencies at least ten times higher than FM frequencies;

an inductor connected to the grounding portion, and configured to short circuit the half-loop radiating element to ground for FM frequencies;

a first matching network or filter connected to the first end of the half-loop radiating element at the feeding portion, for a FM receiver, the first matching network or filter connected to the capacitor in parallel;

a second matching network or filter connected to the second end of the half-loop radiating element at the grounding portion, for another receiver for frequencies at least ten times higher than FM frequencies, the second matching network or filter connected to the inductor in parallel; and a second capacitor arranged parallel to the inductor.

15. The antenna device according to claim 14, wherein the frequencies at least ten times higher than FM frequencies comprises one or more of the following frequency bands: GPS, Bluetooth, WLAN, and WCDMA diversity.

16. A portable radio communication device comprising the antenna device according to claim 14 arranged over a ground plane device.

17. A portable radio communication device comprising:

a half-loop radiating element configured to simultaneously with FM frequencies operate at frequencies at least ten times higher than FM frequencies, the half-loop radiating element including a feeding portion at a first end of the half-loop radiating element operable for feeding of the FM frequencies and a grounding portion at a second end of the half-loop radiating element operable for feeding the frequencies at least ten times higher than FM frequencies;

a capacitor connected to the feeding portion, and configured to short circuit the half-loop radiating element to ground for frequencies at least ten times higher than FM frequencies.

an inductor connected to the grounding portion, and configured to short circuit the half-loop radiating element to ground for FM frequencies;

a FM receiver connected to the antenna device at the feeding portion;

another receiver for frequencies at least ten times higher than FM frequencies connected to the antenna device at the grounding portion, the another receiver comprises a Bluetooth transceiver for frequencies at least ten times higher than FM frequencies connected to the antenna device at the grounding portion;

a FM transmitter connected to the antenna device at the feeding portion;

a first matching network or filter connected to the first end of the half-loop radiating element at the feeding portion, for the FM receiver, the first matching network or filter is connected to the capacitor in parallel;

a second matching network or filter connected to the second end of the half-loop radiating element at the grounding portion, for the Bluetooth receiver, the second matching network or filter is connected to the inductor in parallel; and a second capacitor arranged parallel with the inductor.

* * * * *